United States Patent [19]

Sarton et al.

[11] Patent Number: 4,490,887

[45] Date of Patent: Jan. 1, 1985

[54] CABLE TIE

[75] Inventors: Francois Sarton, Totes; Gérard Roby, Bihorel, both of France

[73] Assignee: Legrand, Limoges, France

[21] Appl. No.: 421,052

[22] Filed: Sep. 22, 1982

[30] Foreign Application Priority Data

Sep. 23, 1981 [FR] France ..... 81 17949

[51] Int. Cl.[3] ..... B65D 63/00

[52] U.S. Cl. ..... 24/16 PB; 24/30.5 P; 248/74.3

[58] Field of Search ..... 24/16 PB, 16 R, 17 R, 24/17 A, 17 AP, 30.5 R, 30.5 P, 483, 484, 150 FP; 248/74.3; 40/21 R; 292/318–321

[56] References Cited

U.S. PATENT DOCUMENTS 2,977,145 3/1961 Rifkin .
3,924,299 12/1975 McCormick ..... 24/16 PB
3,965,538 6/1976 Caveney et al. ..... 24/16 PB
3,991,444 11/1976 Bailey ..... 24/16 PB

FOREIGN PATENT DOCUMENTS 847500 2/1977 Belgium .
2100502 3/1972 France .
2378196 8/1978 France .
2426175 12/1979 France .
2067240 7/1981 United Kingdom ..... 24/16 PB

*Primary Examiner*—Francis K. Zugel
*Assistant Examiner*—James R. Brittain
*Attorney, Agent, or Firm*—Charles E. Brown

[57] ABSTRACT

A cable tie comprises a strap having a series of transverse teeth on one side extending between the longitudinal edges thereof, and a fastening head having a passageway therethrough for receiving the strap to form a loop. The fastening head has a pawl cooperable with the strap teeth. The longitudinal edges of the strap are at least in part transversely oblique and each of the corresponding lateral walls of the passageway are similarly transversely oblique. The transversely oblique edge portions on the strap converge to the side of the strap away from the side having the teeth so that the pawl produces a wedging effect to clamp the strap transversely between the lateral wall portions of the passageway. Also, the lateral wall portions of the passageway converge toward each other in a direction away from the pawl. The oblique portions are preferably surface roughened.

12 Claims, 10 Drawing Figures

CABLE TIE

FIELD OF THE INVENTION

The present invention relates generally to ties usually known as cable ties which are used, for example, to secure together a bunch of wires in some sort of electrical apparatus, and/or secure the bundle of wires to some support or one or more other members in the electrical apparatus.

The invention relates more particularly to cable ties of one-piece construction comprising a flexible strap having a series of transverse teeth extending between the longitudinal edges on at least on side, and a fastening head having a passageway for receiving the flexible strap to close a loop about itself and having a pawl cooperable with the transverse teeth to retain the position of the strap relative to the fastening head.

For securing a bundle of wires together the flexible strap is wound around the bunch of wires before being inserted into the passageway through the fastening head. The strap is then tightened to the desired degree either manually or most often by means of a special tool. During tightening the pawl elastically escapes tooth by tooth along the strap like a ratchet mechanism. When tightening has been terminated, i.e., the traction force has been released, the pawl which is elastically hinged on the fastening head arches in engagement with one or more teeth on the strap thereby resisting any return or opening movement and holding the loop in tension about the bundle of wires in question.

The effectiveness of tightening is then conditioned upon the tensile strength of the flexible strap, particularly at its connecting zone with the fastening head, and by the tensile strength of the fastening head in line with the pawl.

In present day cable ties the tensile strength of the fastening head is usually lower than the tensile strength of the actual strap and therefore the effectiveness of tightening therefore depends on the tensile strength of the fastening head at the pawl.

Most often the longitudinal edges of the strap are parallel to each other and perpendicular to the broad sides or faces of the strap and therefore the cross section is generally rectangular. This is likewise the case with the corresponding passageway through the fastening head. Consequently in the closed position the flexible strap bears against the wall of the passageway opposite the pawl.

It is true that in U.S. Pat. No. 2,977,145 the longitudinal edges of the flexible strap are transversely oblique with respect to each other and such is likewise the case with corresponding walls of the passageway through the fastening head. But in this U.S. patent the longitudinal edges converge in the direction towards the face or side having the teeth, and the patent is totally silent as to the reasons for this arrangement.

OBJECT AND SUMMARY OF THE INVENTION

A general object of the invention is to provide a cable tie whose fastening head tensile strength at the pawl is greater than in known arrangements.

According to the invention a cable tie of one-piece construction is provided comprising a flexible strap having a series of transverse teeth on at least one side thereof, and a fastening head having a passageway therethrough for receiving the strap to form a loop, the fastening head having a pawl retainingly cooperable with the teeth, the longitudinal edges of the strap being at least partly transversely oblique, and the corresponding lateral walls of the passageway oblique with respect to each other. The cable tie, according to the invention, is characterized by the oblique edge of the strap converging to the side opposite the side having the teeth.

In other words, contrary to the arrangement disposed U.S. Pat. No. 2,977,145 mentioned above, the longitudinal edges of the strap converge to the opposite side of the strap having the teeth cooperable with the pawl.

In conjunction therewith the corresponding lateral walls in the passageway through the fastening head are similarly inclined. Consequently, when the strap is inserted in the passageway a wedging effect is developed through the bias of the pawl forcefully transversely clamping the strap between the corresponding walls of the passageway.

The tensile strength of the fastening head produced by the pawl gripping the strap against the corresponding walls of the passageway through the fastening head is considerably improved, all other things being equal, and therefore considerably increases in the same proportions the overall tightening capacity of cable tie.

According to another feature of the invention, to further augment the tensile strength of the fastening head, the friction between the strap and the corresponding walls of the passageway through the fastening head is increased. To this end, the oblique transverse portions of the longitudinal edges are roughened by sanding and/or at least the oblique transverse portions of the lateral walls of the passageway are similarly treated.

The features and advantages of the invention will be brought out in the description which follows, given by way of example, with reference to the accompanying schematic drawings.

DESCRIPTION OF THE PREFERRED EMBODIMENT

Figure 1:
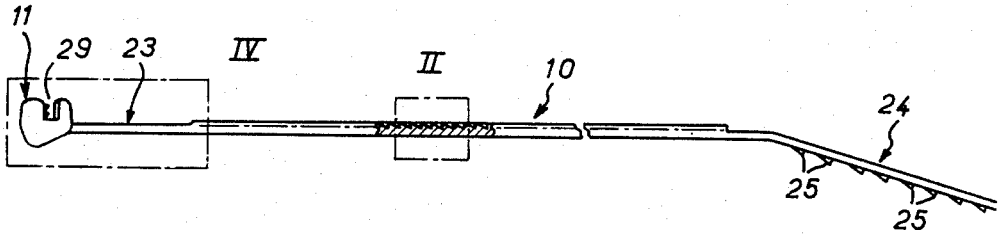
FIG. 1 is an elevational view with a cutaway zone of a cable tie embodying the invention.

As shown in the drawings, the cable tie, according to the invention, may be of one-piece molded construction of a suitable plastic material and comprises a flexible strap 10 and a fastening head 11 at one end thereof.

On at least one of the sides of the strap 10, and in practice on only one side which is the upper or outer side 12 in the illustrated embodiment, the strap 10 has a series of transverse teeth 15 extending between the longitudinal edges 13 of the strap. As shown the teeth 15 are uniformly longitudinally spaced and a thick marginal zone 16 is provided on each side of the series of teeth 15 and at the same level as the teeth. The teeth 15 are assymmetrical. The leading flank 17, that is the one closer to the fastening head 11, is steeper practice nearly vertical) than the trailing flank 18. Consequently, the upper or outer surface defined by the upper or outer side 12 of the strap 10 is essentially that of the marginal zones 16.

As shown, the lower or inner side 20 of the strap is flat and smooth and extends parallel to the upper side 12. Alternatively, the lower or inner side 20 of the strap may be more or less curved, with concave or convex curvature.

In accordance with the invention at least a portion of each of the longitudinal edges 13 of the strap 10 is transversely oblique. In practice, only a portion 21 of each of the longitudinal edges 13 adjacent the lower side 20 is transversely oblique, the remainder or portion 22 of each of the longitudinal edges adjacent the upper side 20 is in line with the corresponding marginal zone 16 and at right angles to the upper side 12.

Figure 3:
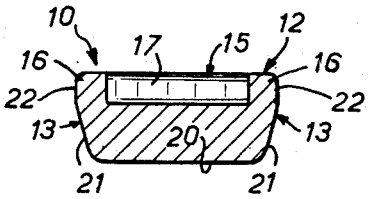
FIG. 3 is, on the same scale as FIG. 2, a transverse sectional view of the strap taken along line III—III in FIG. 2.

According to the invention the transversely oblique portions 21 converge to the side opposite the upper side 12 having the teeth 15. In other words, the transversely oblique portions 21 transversely converge from the upper side 12 toward the lower side 20. As best shown in FIG. 3, the transverse section through the strap 10 is at least in part trapezoidal, with the smaller base coinciding with the surface of the lower side 20.

Figure 4:
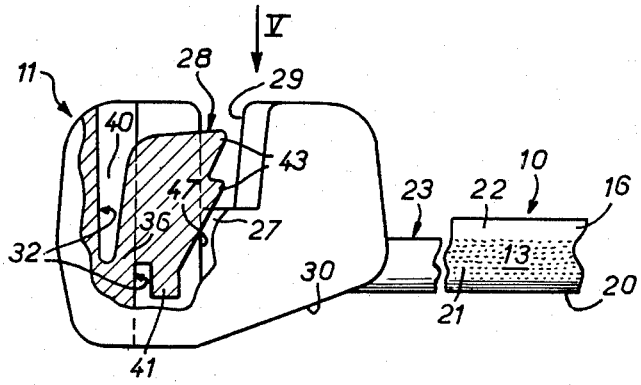
FIG. 4 shows, on a larger scale, the portion of the cable tie within the box IV, with a cutaway area.

Preferably, as represented by the stipple in FIG. 4, the transversely oblique portions 21 are roughened. Such a roughening translates into a surface roughness which may be obtained in the usual way by sanding. In addition, surface roughness may be provided on the lower side 20 of the strap 10.

In practice, as shown, the strap 10 is joined to the fastening head 11 by a connecting strip 23 having the same width but devoid of teeth. Also, remote from the fastening head 11 is a gripping tab 24 with teeth 25 to facilitate grasping of the strap. As shown, the teeth 25 are on the lower side of the gripping tab 24 and therefore, more generally, on the side of the strap 10 opposite the side 12 having the teeth 15.

As is known per se, the fastening head 11 of the cable tie comprises a passageway 27 for receiving the gripping tab 24 of the strap to close a loop about itself and it is provided with a pawl 28 cooperable with and retaining the teeth 15 on the strap 10.

In the illustrated embodiment the passageway through the fastening head 11 extends generally at right angles to the general plane of the strap when it lies flat whereby, as will be brought below, when the strap forms a loop, the ends of the strap one of which joins the strap to the fastening head and the other of which is received in the passageway 27 through the fastening head 11, are substantially perpendicular to each other. Accordingly, such a cable tie is referred to as a "perpendicular head" type.

It goes without say, however, that the invention equally relates to the "tangential head" or "parallel head" type, i.e., cable tie in which the passageway through the fastening head extends substantially parallel to the general plane of the strap when it lies flat. In this case the respective ends of the strap are parallel to each other when the strap forms a loop.

Figure 5:
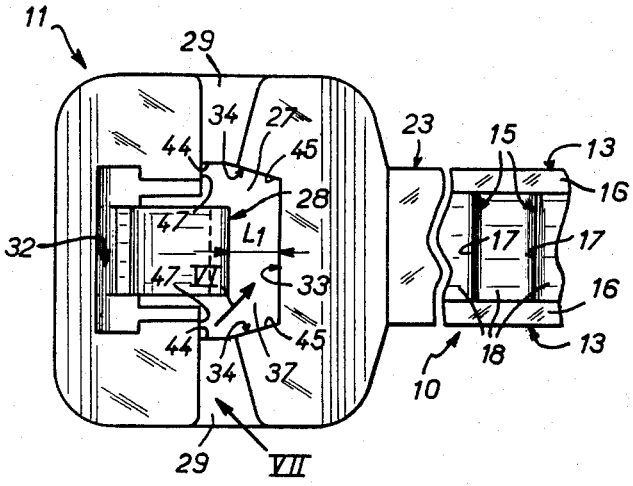
FIG. 5 is a partial plan view on the same scale as FIG. 4, taken in the direction of arrow V in FIG. 4.

In plan view, for example in FIG. 5, it is seen that the fastening head 11 forms a frame of generally rectangular contour. The transverse sides of the frame, i.e., the sides substantially perpendicular to the strap 10 are full height and of solid configuration. On the other hand, the lateral sides of the frame which are substantially parallel to the strap 10 each have a rather large notch 29. In practice the notches 29 open upwardly or outwardly toward the exit of the passageway 27, that is, in the same direction as the insertion of the strap into the passageway 27.

It will be noted that the strap 10 is joined by its connecting strip 23 to the middle of the fastening head 11. In other words, the strap 10 is joined to the fastening head 11 between the faces of the fastening head 11 onto which opens the passageway 27. In practice, on the strap side of the fastening head 11, the face onto which the inlet opening of the passageway 27 opens is inclined downwardly and inwardly from the strap 10. While remaining relatively massive, and thereby robust and relatively rigid, the fastening head 11 is thus advantageously lightened which results in a not insubstantial savings of material without any adverse effect on the mechanical properties of the cable tie.

Inside the fastening head 11, the passageway 27 is overall defined by two transverse walls 32, 33 substantially perpendicular to the strap 10, transverse wall 32 being relatively remote from the strap 10 and the transverse wall 33 being relatively adjacent the same, and two similar lateral walls 34.

In the illustrated embodiment since the teeth 15 on the strap 10 are disposed on the upper or outer side 12 thereof, the pawl 28 extends from the transverse wall 32 of the passageway 27 which,as we have just seen is the transverse wall relatively remote from the strap 10.

Figure 2:
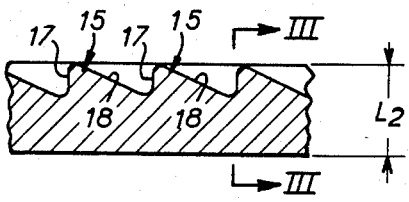
FIG. 2 shows, on a larger scale, the portion of the strap included within the box II in FIG. 1.

The pawl 28 is in one-piece with the transverse wall 32 from which it protrudes and is joined thereto by a zone of reduced section defining a hinge. Bearing in mind the nature of the material of which the cable tie is made, namely, plastic, the pawl 28 is elastically hinged on the fastening head 11 and in its rest position it defines with the facing transverse wall 33 a throat 37 having a width L1 less than the thickness L2 of the strap (FIGS. 5 and 2). In other words, in this embodiment, the pawl 28 does not protrude outside the fastening head 11. It should be noted, however, that the free end of the pawl 28 is in line with the notches 29 in the fastening head thereby facilitating molding.

The swinging movement of the pawl 28 is limited in a first direction by the transverse wall 32 to which it is joined, the pawl 28 abutting transverse wall 32 thereby taking up the blind notch or tecess 40 normally separating the back of the pawl 28 from transverse wall 32. The swinging movement of pawl 28 is limited in the other, second direction by transverse wall 32, a heel 41 at the bottom of the pawl 28 abutting the corresponding part of transverse wall 32.

Pawl 28 has at its free end two coooerable teeth 43 for meshing with the teeth 15 on the strap 10 to retain the latter.

According to a feature of the invention, in a manner similar to the longitudinal edges 13 of the strap 10, at least a part of each of the lateral walls 34 of the passageway 27 through the fastening head 11 is transversely oblique with respect to the other. In practice the lateral walls 34 comprise a portion 44 substantially parallel to the strap 10 and a portion 45 oblique thereto.

Preferably, the transversely oblique portions 45 converge transversely away from the pawl 28. At least part of said oblique portions 45 is in transverse alignment with the free end of the pawl 28.

Figure 6:
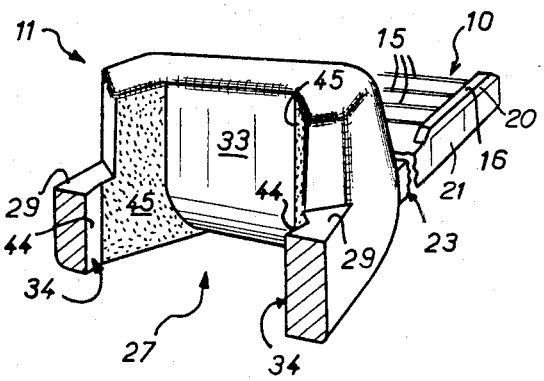

In practice, as best shown in FIG. 6, the oblique portions 45 extend along the entire height of the passageway 27 through the fastening head 11. Preferably, as shown by stipple in FIG. 6, the oblique portions 45 are roughened, by the same process and for the same reasons given above.

Figure 7:
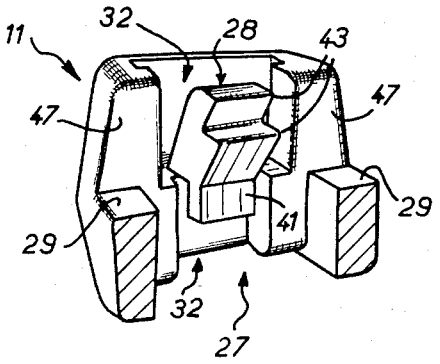
FIGS. 6 and 7 are partial perspective views of the cable tie taken in the directions of arrows VI and VII, respectively, in FIG. 5.

In practice, and as known per se, the passageway 27 through the fastening head 11 has two coplanar shoulders 47 disposed on opposite sides of the pawl 28, as shown in FIGS. 4, 5 and 7. According to a feature of the invention, as will appear hereinbelow, these shoulders 47 are sufficiently close to the free end of the pawl 28 so as to bear the strap 10 when the strap is received in the passageway 27. In practice, the shoulders 47 face away from the transverse wall 32 toward the opposite transverse wall 33. Nevertheless, for the sake of molding convenience, and as will best seen in FIG. 7, they are wider at the level of the heel 41 than at the level of the free end of the pawl 28.

Figure 8:
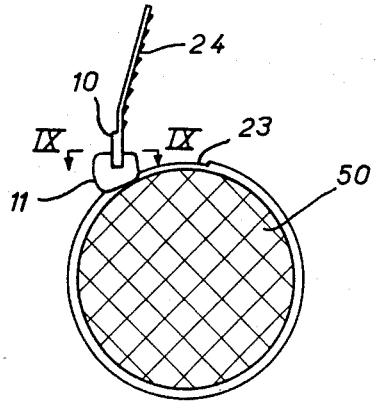
FIG. 8 is an elevational view illustrating operation of the cable tie.
Figure 9:
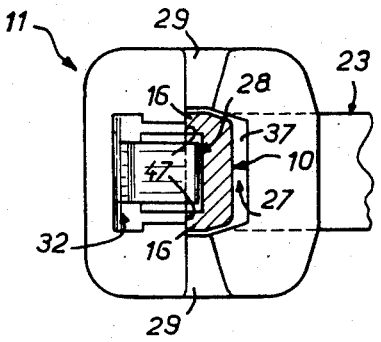
FIG. 9 shows, on a larger scale, a sectional view taken along line IX—IX in FIG. 8 during the first step of tightening the cable tie.

To use the cable tie, for example as schematically illustrated in FIG. 8, to tie a bundle of wires 50 together, the cable tie is wound around thebundle of wires 50, and its gripping tab 24 is inserted into the passageway 27 through the fastening head 11. By the traction force exerted thereon, the strap 10 bears along its margins 16 against the shoulders 47 formed inside the passageway 27. At the same time, while traction is exerted on the strap 10, the pawl 28 elastically escapes the teeth 15 of strap one at a time, the corresponding swinging movement of the pawl 28 being limited rearwardly by the transverse wall 32 of the passageway 27 through the fastening head 11. Once the traction force exerted on strap 10 is released, the pawl 28 elastically urges the strap 10 toward the transverse wall 33 of the passageway 27, as shown in FIG. 10.

The transversely oblique portions 21 of the longitudinal edges 13 of strap 10 then come into contact with the corresponding transversely oblique portions of the lateral walls 34 of the passageway 27. Thereupon, through the bias of the pawl 28, a wedging effect is developed by transverse clamping of the strap 10 between the lateral wall portions 34 of the passageway 27 through the fastening head 11, which is all the more reliable as this occurs between roughened surfaces of the fastening head and the strap.

Figure 10:
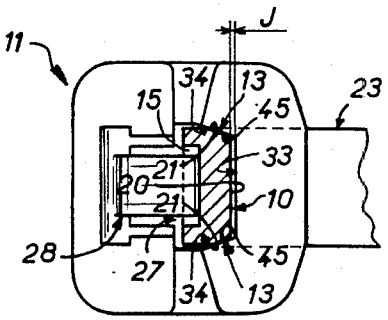
FIG. 10 is a view similar to that of FIG. 9 after the final tightening step.

In the illustrated embodiment, and as best viewed in FIG. 10, a clearance J remains between the inner or lower side 20 of strap 10 and the corresponding transverse wall 33 of passageway 27 through fastening head 11. Still, if under the bias of the pawl 28, in particular, the strap 10 bends transversely this clearance J may disappear.

The invention is not intended to be limited to the illustrated embodiment, but on the contrary, is intended to encompass, all variations and alternatives understood to those skilled in the art, without departing from the spirit and scope of the invention.

For example, the expression "generally oblique" or "generally transversely oblique" as applied to all or part of the longitudinal edges of the strap does not mean that the edges are planar as illustrated; they may be at least in part curved. In addition, instead of being trapezoidal, the lower part of the strap may be triangular in section.

Furthermore, as mentioned above, the field of the invention is not limited to cable ties with "perpendicular" heads but equally applies to "tangential" fastening heads.

Moreover, the field of the invention is not limited to straps having teeth on the upper or outer side as shown herein, but covers straps having teeth on the lower or inner side.

Finally, the teeth may be provided on both sides of the strap, in which case the teeth on the lower or inner side of the strap may be cooperable with a tooth facing the pawl 28, e.g., on the opposite transverse wall 33 of the passageway 27.

What we claim is:

1. A cable tie of one-piece construction comprising a flexible strap having a series of transverse teeth disposed on one side of said strap and extending between the longitudinal edges thereof, and a fastening head having a passageway therethrough for receiving said strap to form a loop, said fastening head having a pawl retainingly cooperable with said teeth, said longitudinal edges of said strap being at least in part transversely oblique, and each of the corresponding lateral walls of said passageway through said fastening head having at least a portion similarly transversely oblique, said passageway including a transverse wall extending between said transversely oblique portions of said lateral walls, the improvement wherein said transversely oblique edge portions on said strap converge towards each other to the other side of said strap, said cable tie having a normal closed position wherein said strap is received in said passageway and said transversely oblique portions of said longitudinal edges of said strap are urged under the bias of said pawl against the transversely oblique portions of the lateral walls of said passageway while transverse clearance is defined between said transverse walls of said passageway and a corresponding transverse portion of said other side of said strap facing away from said transverse wall, said pawl bias forming means for producing a wedging action in the normal closed position of the cable tie.

2. The cable tie of claim 1, wherein said transversely oblique lateral wall portions of said passageway converging toward each other in a direction away from said pawl.

3. The cable tie of claim 1 or 2, wherein said transversely oblique lateral wall portions are at least in part in transverse alignment with the free end of said pawl.

4. The cable tie of claim 1 or 2, wherein said transversely oblique lateral wall portions are surface roughened.

5. The cable tie of claim 1 or 2, wherein said transversely oblique edge portions of said strap are surface roughened.

6. The cable tie of claim 1 or 2, wherein said transversely oblique wall portions and said transversely oblique edge portions are surface roughened.

7. The cable tie of claim 1 or 2, wherein said passageway through said fastening head has two coplanar shoulders to opposite sides of said pawl, said strap bearing against said coplanar shoulders when said strap is received in said passageway.

8. The cable tie of claim 7, said pawl extending from another transverse wall of said passageway, wherein said shoulders protrude from said lateral walls of said passageway and face the first-mentioned transverse wall.

9. The cable tie of claim 7, said pawl having a heel, wherein said shoulders are wider at the level of said heel than at the free end of said pawl.

10. The cable tie of claim 1 or 2, wherein said strap is joined to said fastening head at the middle thereof between faces of said fastening head onto which said passageway opens.

11. The cable tie of claim 10, wherein on the side adjacent said strap, said fastening head face, onto which opens the inlet opening of said passageway, has an inclined slope.

12. The cable tie of claim 1, wherein said transverse portion of the other side of said strap has a transverse extend reater than that of said transverse wall of said passageway.

* * * * *